US006930609B1

(12) United States Patent
Florenz et al.

(10) Patent No.: US 6,930,609 B1
(45) Date of Patent: Aug. 16, 2005

(54) DEVICE AND METHOD FOR TRANSMITTING DATA BETWEEN A SENSOR AND AN ANALYSER UNIT

(75) Inventors: Hans-Jörg Florenz, Maulburg (DE); Armin Wernet, Rheinfelden (DE)

(73) Assignee: Endress + Hauser GmbH + Co. KG, Maulburg (DE)

( * ) Notice: Subject to any disclaimer, the term of this patent is extended or adjusted under 35 U.S.C. 154(b) by 0 days.

(21) Appl. No.: 10/129,107

(22) PCT Filed: Oct. 31, 2000

(86) PCT No.: PCT/EP00/10710

§ 371 (c)(1),
(2), (4) Date: Sep. 10, 2002

(87) PCT Pub. No.: WO01/35369

PCT Pub. Date: May 17, 2001

(30) Foreign Application Priority Data

Nov. 11, 1999 (DE) ..... 199 54 186

(51) Int. Cl.[7] ..... G08B 21/00
(52) U.S. Cl. ..... 340/612; 340/603; 340/620
(58) Field of Search ..... 340/603, 612, 340/613, 614, 615, 617, 853.1, 622, 616, 618, 620, 623, 626, 853.3; 73/290 V, 304 C, 313, 152.46, 152.54, 319; 118/715, 723 E; 166/250.03, 372

(56) References Cited

U.S. PATENT DOCUMENTS 4,532,892 A * 8/1985 Kuzara ..... 119/51.02
5,122,794 A 6/1992 Warrior ..... 340/825.2
6,226,212 B1 * 5/2001 Sakamoto et al. ..... 365/207
6,363,785 B1 * 4/2002 Senghaas et al. ..... 73/313
6,516,879 B1 * 2/2003 Hershberger ..... 166/250.03
6,693,553 B1 * 2/2004 Ciglenec et al. ..... 340/853.1

OTHER PUBLICATIONS

Scholz W. et al: Interkama '92: Intelligent Transmitters for Process Measurement, Bd. 60, Nr. 4, Apr. 1, 1993.

Holladay K.L: "Lalibrating Hart Transmitters" Advances in Instrumentation and Control . . . , Bd. 50, Nr. Part 03, Oct. 1, 1995.

Lattka A.L.: "Smartes Messen Im Prozess" Elektrotechnik, DE, Vogel Verlag K.G. Wurzburg, Bd. 73, No. 9, Sep. 20, 1991.

* cited by examiner

*Primary Examiner*—Van T. Trieu
(74) *Attorney, Agent, or Firm*—Bacon & Thomas

(57) ABSTRACT

A device for transmitting data between a sensor, in particular a capacitive level sensor, and an analyser unit, whereby the sensor and the analyser unit are physically separate from each other and a method for operating said device. The device and method permit the testing and/or adjusting and/or operation of a sensor, which is active. A first processor unit is dedicated to the sensor and a second processor unit is dedicated to the evaluating unit. Connecting lines are provided, by means of which both processor units exchange bi-directional data.

17 Claims, 4 Drawing Sheets

| Modes of operation | | C0 | C1 | S0 | S1 | Data - bits |
|---|---|---|---|---|---|---|
| Response | A | 0 | 0 | 0 | 0 | no data => PSU |
| | B | 0 | 0 | 0 | 1 | |
| | C | 0 | 0 | 1 | 0 | |
| | D | 0 | 0 | 1 | 1 | |
| Threshold level: | | Standard mode | | | | D0 ... D1 |
| Measuring: | | 0 | 1 | 0 | 1 | D0 ... D8 |
| Store in memory: | | 1 | 0 | 1 | 0 | no data => PSU |
| Read out EEPROM: | | 1 | 1 | 0 | 0 | D0 ... D8 |

DEVICE AND METHOD FOR TRANSMITTING DATA BETWEEN A SENSOR AND AN ANALYSER UNIT

FIELD OF THE INVENTION

The invention relates to a device for transmitting data between a sensor, in particular a capacitive fill-level sensor or a pressure sensor, and an evaluating unit, wherein the sensor and the evaluating unit are spatially separated. Moreover, the invention relates to a method for adjusting, testing and operating the device in accordance with the invention.

BACKGROUND OF THE INVENTION

Although reference will always be made to a capacitive fill-level sensor in what follows, the invention can basically be applied to any type of measuring device in which the sensor and the evaluating unit have a defined spatial distance from each other. Thus, the device in accordance with the invention, or the method in accordance with the invention, can also be employed in connection with a pressure sensor.

A capacitive fill-level probe is known from DE 195 36 199 C2, which is mounted at the level of the fill level to be monitored. Such probes are also called threshold level detectors and are mounted in the form of overflow protection devices in containers or, upstream of pumps, as protection devices against running empty. If the probe is covered by the filler material to be respectively detected, it has a larger capacitance than in the uncovered state. The measured capacitance value is compared with a threshold value by means of a capacitance measurement circuit and a comparator; from the result it is possible to determine whether the fill level to be monitored has been reached, or has not yet been reached. The setting of the threshold value, or of the switch point, is of course extremely critical in this connection. Therefore the solution disclosed in DE 195 36 199 has as its aim to propose an automatic method for optimizing the setting of the switch point.

The rope probe described in EP 0 857 954 is employed when the measurement using a fill-level sensor or pressure sensor is to be performed at a location which is not easily accessible from the outside. An example of this is the placement of a probe at a defined height inside a tank or a reservoir. The rope is used for fixing the probe in place. The electrical supply and unidirectional transmission of measuring signals between the probe and the evaluating unit integrated in a housing takes place at the same time.

The solution described in EP 0 857 954 A1 describes a device for fastening the rope to the probe in which the device withstands all process-related stresses, in particular large tensional forces. However, the laid-open publication does not contain any clue regarding a bidirectional data exchange between the probe and the remotely located evaluating unit.

Moreover, the adjustment of the sensor for correct setting of the switch point is of quite considerable importance for the dependable and correct operation of the sensor during the process.

Besides, tolerances in the electronic and mechanical components are compensated by the adjustment. Since sensors are customarily encapsulated following mounting, an adjustment, for example by means of the torsion of a potentiometer or the installation of an additional resistor, is no longer possible. Therefore the sensor must be laid out in such a way that it can be adjusted from the outside.

SUMMARY OF THE INVENTION

The object of the invention is to provide a device and a method which make it possible to test and/or to adjust and/or to operate a sensor, which is part of the process, from the outside.

The object is attained in that a first processor unit is provided, which is assigned to the sensor, and that a second processor unit is provided, which is assigned to the evaluating unit, and that at least one connecting line is provided over which the two processor units exchange data bidirectionally. It is thus not only possible that the sensor supplies the determined measuring data to the evaluating unit, but data and signals are also transmitted from the evaluating unit to the sensor. The transmitted data are, for example, an adjustment value, wherein this adjustment value adjusts mechanical and/or electrical deviations among the sensors, or they show the response progression of the sensor, which mirrors the measured data supplied by the sensor as a function of the degree of coverage. Thereafter an adjusted sensor can be connected with any arbitrary evaluating unit, since all respectively adjusted sensors show a uniform behavior to the outside. Conclusions regarding malfunctions of the sensor can be drawn from the stored response progression.

A preferred further development of the device of the invention provides for the second processor unit to be integrated in the evaluating unit and/or the second processor unit to be integrated in an auxiliary device, for example a PC (personal computer). If the sensor is connected with a PC, it is possible to check and test it at arbitrary intervals in respect to its functionality in the process, for example by means of a test and/or simulation program stored in the PC. The device in accordance with the invention, which is based on two processor units communicating with each other, also detects if the sensor fails. It remains to be stated that the desired functional ability of the device is achieved in a cost-effective manner.

In accordance with an advantageous further development of the device of the invention, one of the processor unit is a master processor and the other processor unit a slave processor. The master and slave processors are preferably connected with each other over two data lines, wherein one data line is a unidirectional line, through which the master processor provides the clock pulse, and the other data line is a bidirectional line through which the two processor units communicate with each other. The digital data communication has the known advantage over the analog data communication of a substantially greater interference protection.

In accordance with an advantageous further development of the device of the invention it is provided that the electrical current supply of the sensor takes place over the two data lines (two-wire circuit), or that two further lines are provided, over which the electrical current supply of the sensor takes place (four-wire circuit).

For reducing the manufacturing cost, it is provided in accordance with the preferred embodiment of the device of the invention that an RC oscillator, which generates the clock pulse for the communication between the two processor units, is assigned to each of the two processor units. Incidentally, to keep the power consumption of the processor units as low as possible, they are operated at a relatively low clock pulse (approximately 1 to 2 MHz).

In accordance with a preferred aspect of the device of the invention, the signals representing the measured quantity respectively to be determined are processed in the processor unit assigned to the sensor. It is furthermore provided that the processor unit assigned to the sensor has a memory unit, in which the quantity to be measured for matching the sensor to a reference variable, the so-called adjustment value, is stored.

In respect to the method for adjusting, testing and operating the above described device of the invention, the object is attained in that the data exchange between the two processor units is performed by a clock pulse flank-controlled point-to-point transmission. This type of digital communication is distinguished by its reaction being relatively little prone to clock pulse fluctuations of the processor units. This is important because for reasons of cost the processor units are preferably operated with RC oscillators. Incidentally, in this connection, relatively little prone means the relative clock pulse fluctuations of up to −50% and +100%, which can be caused by tolerances and aging, do not impair the data transfer.

In accordance with an advantageous further development of the method of the invention it is provided that in the adjustment and test phase the sensor is switched into the measuring mode, and that for determining the respective value of the quantity to be measured, the sensor is switched into the normal mode.

Furthermore, an advantageous embodiment of the method of the invention provides that during measuring operations the response of the sensor is determined by approaching or simulating defined values of the quantity to be measured, and that the detected response course is stored. As already previously described, the response course is preferably stored in the processor unit of the auxiliary device (for example the PC).

In accordance with an advantageous further development of the method of the invention it is provided that following final installation, the sensor is connected with an auxiliary device, for example a PC, that the auxiliary device switches the sensor into the measuring mode, that the response course of the sensor is recorded and that a check is made on the basis of the stored values of the quantity to be measured whether the sensor operates correctly. The response course of the sensor is here understood to be the measuring voltage as a function of the degree of the covering of the sensor. The determination and checking of the response curve is important for detecting manufacturing errors and scattering.

An advantageous embodiment of the method of the invention provides that reaching a predetermined value of the quantity to be measured is simulated, and that the measured value of the value to be measured is permanently stored as the adjustment value. Moreover, it is proposed that the stored value of the quantity to be measured is verified by means of a subsequent check operation before the final storage of the adjustment value takes place.

Incidentally, the adjustment or reference value is located in the vicinity of the subsequent switch point for a filler material to be detected with a small dielectric constant. It is possible by means of these steps to keep tolerances very low. Incidentally, the actual switch points are determined in accordance with a definite rule for computing. The corresponding detection method already constitutes the prior art.

In accordance with an advantageous further development of the method of the invention, the switching threshold for reaching the predetermined quantity to be measured is determined during initialization on the basis of the adjustment value and of the response value transmitted by the master processor in the evaluating unit in those cases, where the sensor is employed as a threshold limit switch, which signals when a predetermined measured value has been reached, for example the reaching of a threshold fill level in a container.

In particular, it is provided that exceeding or falling below the switching threshold is transmitted to the processor unit operating as the master processor, that on the basis of the transmitted data the master processor forms an average value and that, following definite detection of the switching state, this average value is forwarded to an output/display unit. An improved interference suppression is made possible by forming the average value. A switching delay is simultaneously realized. Only after a definite determination of the switching status is the latter forwarded to the output and, for example, to a switching status indicator.

BRIEF DESCRIPTION OF THE DRAWINGS

The invention will be explained in greater detail by means of the following drawings. Shown are in.

DETAILED DESCRIPTION OF THE PREFERRED EMBODIMENTS

Figure 1:
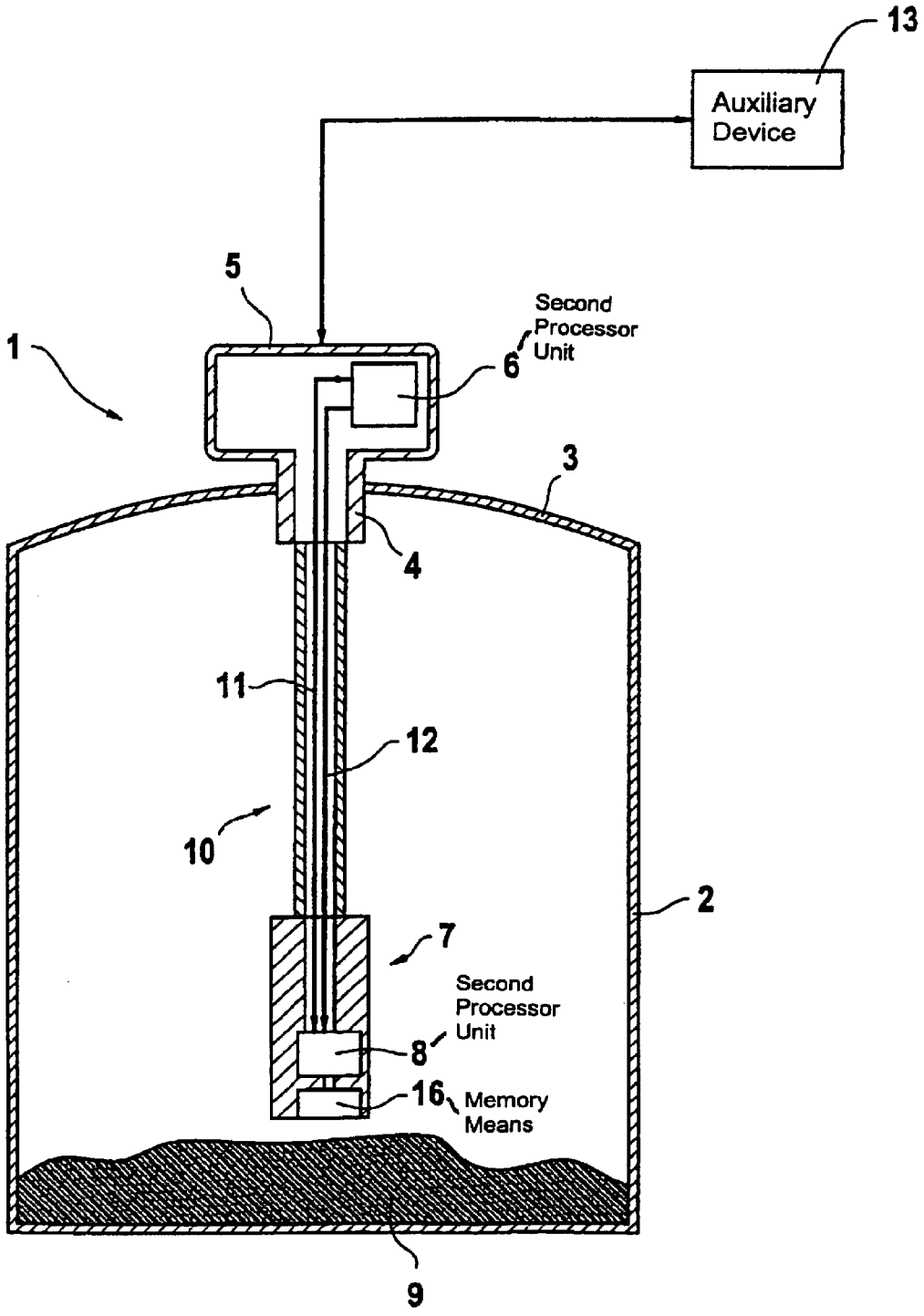
FIG. 1, a schematic representation of an embodiment of the device of the invention, FIG. 2, a circuit diagram representing the data communication between both processor units, FIG. 3, a characteristic transmission curve of the noise-suppression elements, FIG. 4, a flow chart of the communication between the two processor units on the bit level, and FIG. 5, a flow diagram for testing the device of the invention.

FIG. 1 shows a schematic representation of an embodiment of the device 1 of the invention. In the case illustrated, the device 1 of the invention is intended to determine the fill level limit of a filler material 9 in the container 2. The device 1 is put together from a sensor 7, which is in the container 2, an evaluating unit 5, which is mounted outside of the container in an opening 4 in the cover 3 of the container 2, and a connecting means 10, for example a cable or a rope, which connects the sensor 7 with the evaluating unit 5.

A first processor unit 6 is assigned to the evaluating unit 5, and a second processor unit 8 to the sensor 7. The processor unit 6 assigned to the evaluating unit 5 preferably is a master processor, and the processor unit 8 assigned to the sensor 7 is a slave processor. Both processor units 6, 8 communicate with each other via data lines 11, 12, wherein the data line 11 is a unidirectional data line, over which the master processor 6 provides a clock pulse. The second data line 12 permits a bidirectional data exchange between the master processor 6 and the slave processor 8. For adjusting or testing and/or operating, the device 1 in accordance with the invention can be is connected with an auxiliary device 13, preferably a personal computer. An adjustment value determined for the respective sensor 7 is stored in the memory means 16 which, the same as the slave processor 8, is integrated in the sensor 7.

Figure 2:
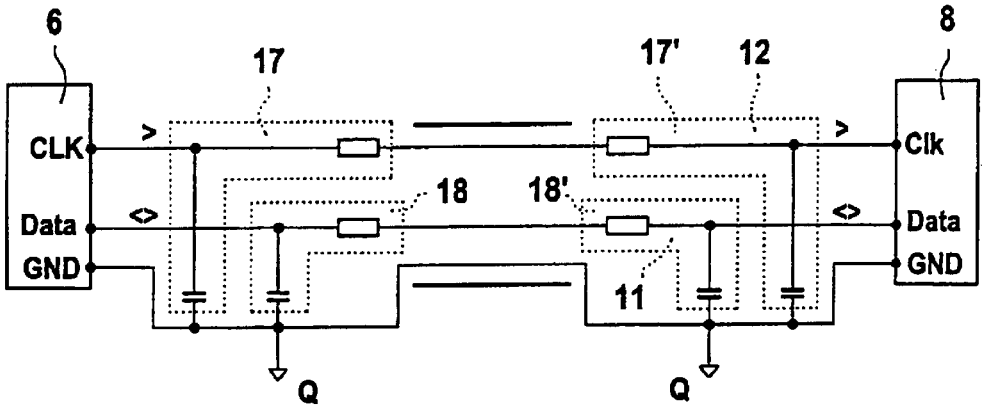

FIG. 2 represents a circuit diagram, which explains the data communication between the two processor units 6, 8 in greater detail. As already described earlier, the two processor units 6, 8 are a master processor 6 and a slave processor 8. The master processor 6 provides the clock pulse for the data transmission via a unidirectional data line 12; the data exchange between the two processor units 6, 8 takes place over the bidirectional data line 11. Noise-suppression elements 17, 17', 18, 18' are connected upstream of the respective inputs, or outputs, of the processor units 6, 8. The noise-suppression elements 17, 17', 18, 18' are low-pass filters, consisting of a resistor 19, 19', 20, 20', and a capacitor 21, 21', 22, 22', wherein the data lines 11, 12 are grounded through the capacitor 21, 21', 22, 22'. The time constants of the RC elements have been selected to be such that, on the one hand, communications are not hampered but, on the other hand, interference input is suppressed to the greatest extent. Moreover, the resistors 19, 19', 20, 20' are of such low impedance that too great a weakening of the signal level is avoided.

Figure 3:
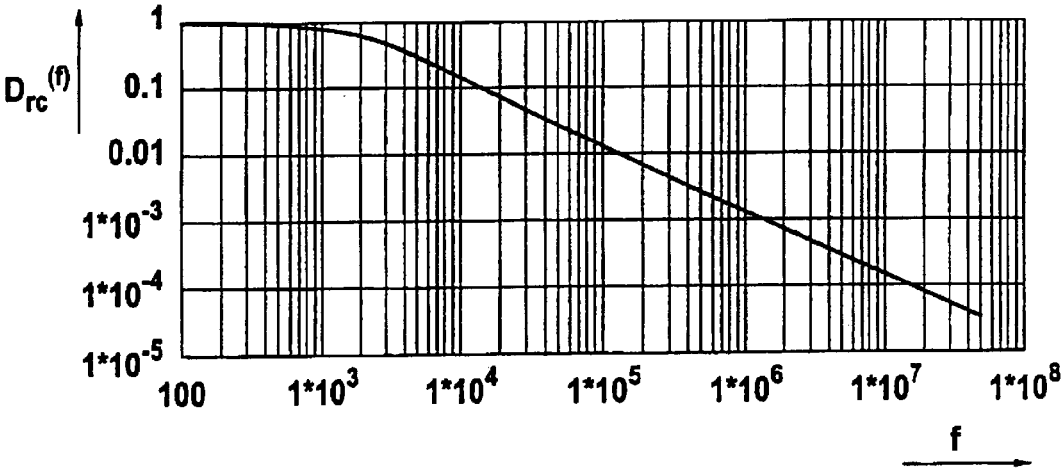

The characteristic transmission curve of a low-pass filter, which can be used with the device of the invention, is represented in FIG. 3. While low-frequency signals can pass almost undamped through the line, high-frequency signals are damped, or completely suppressed. In connection with the present invention, the preferred and sufficient clock pulse frequency lies at approximately 100 Hz. This base frequency, as well as its first harmonic wave, are thus transmitted without damping from the master processor 6 to the slave processor. However, the noise-suppression elements 17, 17', 18, 18' do not merely assure the transmission of data without interference. They also have a protective function when, for example, the data lines 11, 12 are open during assembly.

Figure 4:
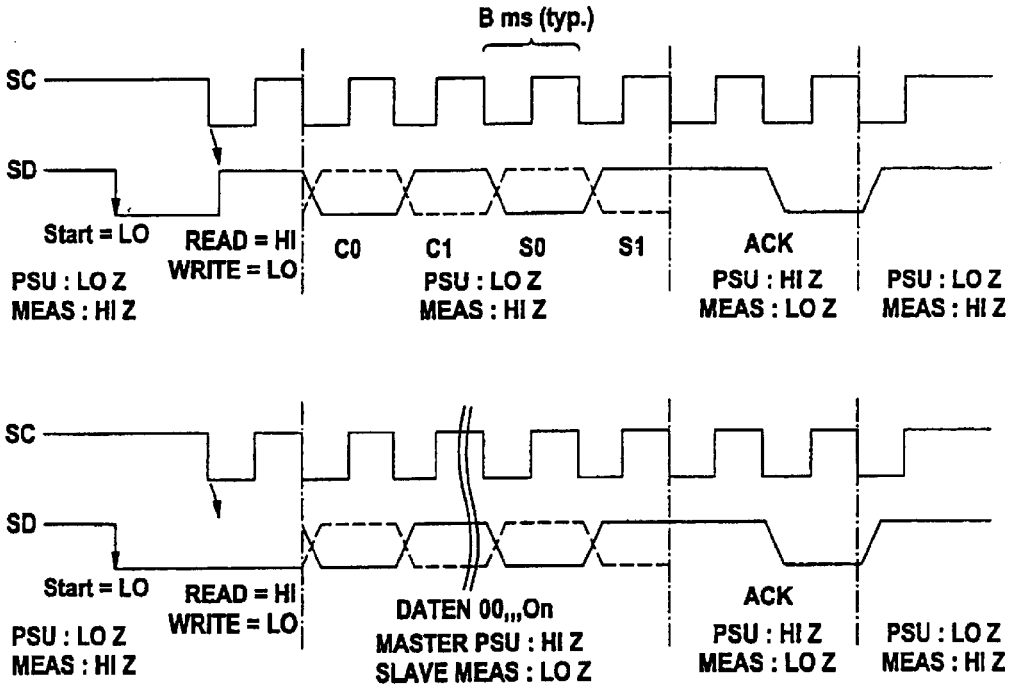

FIG. 4 represents a flow chart of the communication between the two processor units on the digital level. In the illustration, the master processor 6 is identified as PSU, and the slave processor as Meas (=measure). SC characterizes the respective signal levels on the data line 12 which provides the clock pulse. SD identifies the signal level on the data line 12, over which the bidirectional data exchange between the two processor units 6, 8 takes place. The communication between the master processor 6 and the slave processor 8 is represented in the upper portion. The transmission is composed of respectively four bit data. What information is hidden behind the bits can be seen from the table also shown in FIG. 4. Incidentally, in the case represented, the slave processor 8 has received a request from the master processor to produce measured data.

The corresponding communication between the slave processor 8 and the master processor 6 is shown in the lower representation in FIG. 4. During the standard operation of the fill-level sensor as a threshold level detector, 2-bit data are transmitted, which correspond to the state "COVERED", or "UNCOVERED". During testing operations or measuring operations, 10-bit data are transmitted in the case represented.

In the state of rest, both lines 11, 12, or SC, SD, are set to logical 1. Each connection build-up must be initiated via the state of rest "STOP". To initiate a transmission, the master processor 6 sets data to 0, while SC remains on 1. That data may only be changed while SC in set to 0 applies to all further bits. Data are evaluated by the receiver while SC is set to 1.

Each transmission starts with a data direction bit, which is followed by data bits. An identical acknowledgement bit "Ack" is always transmitted at the end as a check. Data protection is preferably provided by a repetition; such a method makes lesser demands on the processor 6, 8 than methods which accomplish protection by means of a parity bit or a check sum.

It is furthermore provided that different response values can be set in the device of the invention for the correct determination of the switch point. A quadruple dip switch is provided in the evaluation unit 5 particularly for this purpose. The processor unit 6 reads off the set value and fixes the switch point as a function of the measured value in the "UNCOVERED" state. The "new" setting of the switch point is always performed when the response setting is changed.

Figure 5:
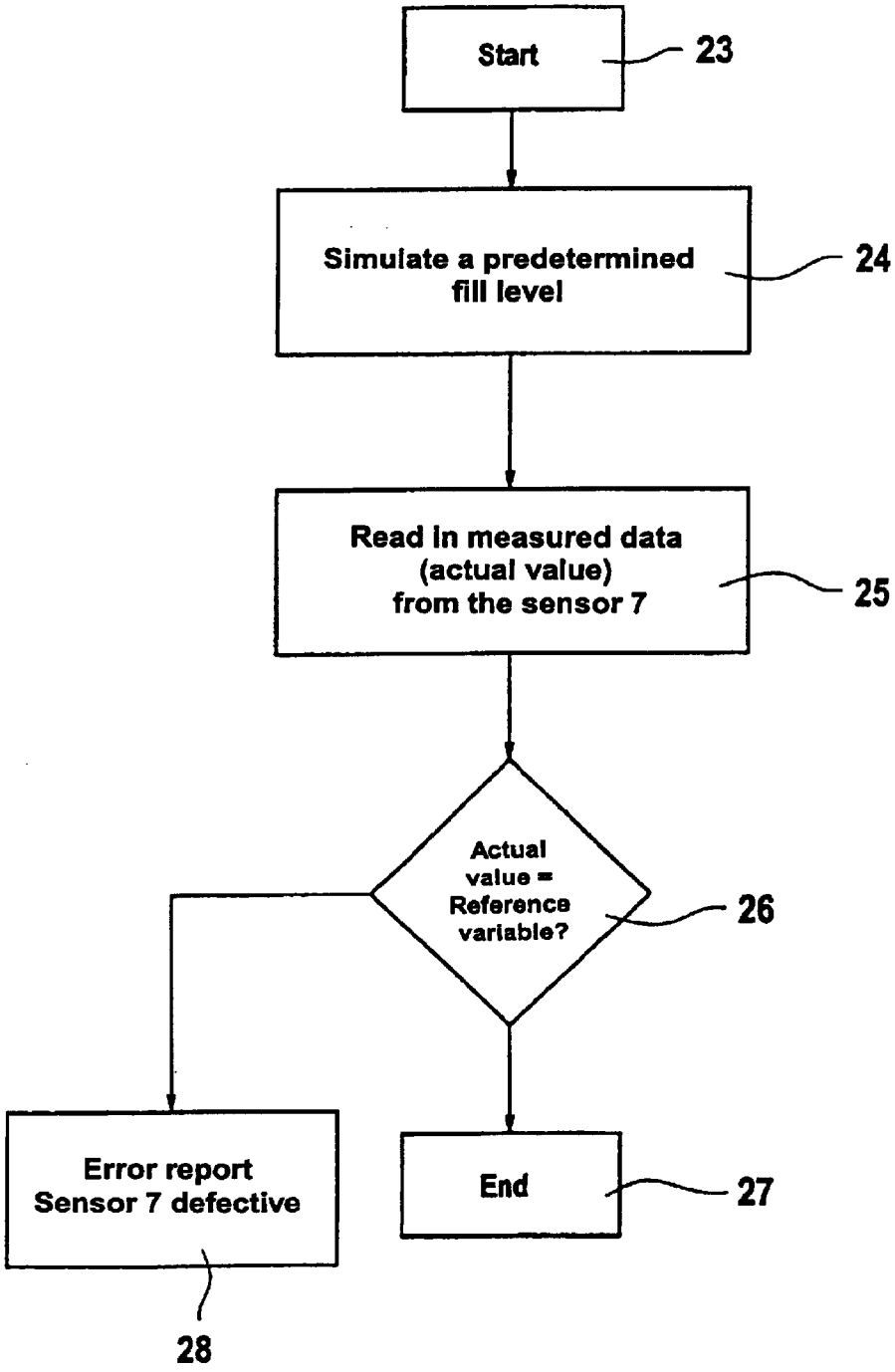

FIG. 5 shows a flow diagram for testing the ability of the sensor 7 to function. For this, the sensor is preferably connected with a PC, in which a simulation/testing program is stored. However, in principle the test can also take place via the processor unit 6, which is integrated in the evaluation unit 5.

Following program start at point 23, a predetermined fill level value is simulated at program point 24. The measured data from the sensor are read in at 25. Thereafter the measured data are compared with the preset reference variables (program point 26). If the measured value does not lie within the tolerance around the predetermined reference variable, an error report is issued at 28; the sensor 7 is defective. But if the actual value corresponds to the reference variable, the program is terminated at point 27.

What is claimed is:

1. A device for transmitting data relative to the fill level limit of a filler material in a container, between a sensor, in particular a capacitive fill-level sensor, or a pressure sensor, and an evaluating unit, wherein the evaluating unit and the sensor are spatially separated from each other, comprising:

a first processor unit connected to the sensor;

a second processor unit connected to the evaluating unit; and connecting lines are provided, which exchange data bidirectionally over said first processor unit and said second processor unit, wherein:

the data exchange between said first processor unit and said second processor unit is performed by a clock pulse flank-controlled point-to-point transmission;

the evaluating unit and said first processor unit are mounted to the container and extend outside of the container;

the sensor and said second processor unit are mounted to extend inside the container; and the sensor and evaluating unit are connected to each other by said connecting lines.

2. The device in accordance with claim 1, further comprising:

an auxiliary device, wherein:

said first processor unit is integrated in the evaluating unit, and/or said first processor unit is integrated in said auxiliary device.

3. The device in accordance with claim 1, wherein:

one of said first processor unit and said second processor unit is a master processor unit and the other is a slave processor unit.

4. The device in accordance with claim 3, wherein:

said connecting lines comprise two data lines; and one of said data lines is a unidirectional line, over which said master processor provides the clock pulse, and the other of said data lines is a bidirectional line, over which the two processor units communicate with each other.

5. The device in accordance with claim 4, wherein:

the electric current supply for the sensor takes place according to one of: said two data lines (two-wire circuit), and two further lines, over which the electric current supply for the sensor takes place (four-wire circuit).

6. The device in accordance with claim 4, further comprising:

two RC oscillators operatively associated with a respective one of said processor units, each generating a clock pulse for communication between said two processor units.

7. The device in accordance with claim 6, further comprising:

noise-suppression elements connected upstream of the inputs, or outputs, of said two processor units, whose time constants are dimensioned in such a way that they suppress the introduction of noise into said data lines to a large extent, but do not interfere with the data exchange between said two processor units.

8. The device in accordance with claim 1, wherein:

said processor unit assigned to the sensor processes signals representing the particular measured value to be determined.

9. The device in accordance with claim 8, wherein:

said processor unit assigned to the sensor has memory means, in which at least one measured value for adjusting the sensor to a reference variable, the so-called adjustment value, can be stored.

10. The device in accordance with claim 9, further comprising:

an auxiliary device, preferably a personal computer, which can be connected with the sensor instead of the evaluating unit, and by means of which the sensor is adjusted and/or tested and/or operated.

11. A method for transmitting data relative to the fill level limit of a filler material in a container between a sensor, in particular a capacitive fill-level sensor, or a pressure sensor, and an evaluating unit, wherein the evaluating unit and the sensor are spatially separated from each other, comprising the steps of:

providing a normal mode of operation and a measuring mode of operation relative to an adjustment and test phase;

switching the sensor into said measuring mode in said adjustment and test phase; and switching the sensor into said normal mode for determining the respective value of the quantity to be measured.

12. The method in accordance with claim 11, further comprising the steps of:

determining the response of the sensor during measuring operations by approaching or simulating defined values of the quantity to be measured; and storing the respective response values.

13. The method in accordance with claim 11, further comprising the steps of:

connecting the sensor with an auxiliary device following final installation;

switching the sensor into said measuring mode by the auxiliary device;

recording the response course of the sensor; and checking whether the sensor operates correctly on the basis of the stored values of the quantity to be measured.

14. The method in accordance with claim 13, further comprising the step of:

reaching a predetermined value of the quantity to be measured by simulation, and permanently storing the measured value of the value to be measured as the adjustment value.

15. The method in accordance with claim 14, wherein:

the stored value of the quantity to be measured is verified by means of a subsequent check operation.

16. The method in accordance with claim 14, wherein:

where the sensor is employed as a threshold limit switch which signals when a predetermined measured value has been reached, for example the reaching of a threshold fill level in a container, the switching threshold for reaching the predetermined quantity to be measured is determined during initialization on the basis of the adjustment value and of the response value transmitted by the master processor in the evaluating unit.

17. The method in accordance with claim 16, further comprising the steps of:

transmitting to the processor unit operating as the master processor values that exceed or fall below the switching threshold;

forming an average value with the master processor on the basis of the transmitted data; and forwarding the average value to an output/display unit following definite detection of the switching state.

* * * * *